United States Patent [19]

Winslow et al.

[11] 4,370,401

[45] Jan. 25, 1983

[54] LIGHT SENSITIVE, THERMALLY DEVELOPABLE IMAGING SYSTEM

[75] Inventors: John M. Winslow, South St. Paul; Kenneth G. Gatzke, Lake Elmo, both of Minn.

[73] Assignee: Minnesota Mining and Manufacturing Company, St. Paul, Minn.

[21] Appl. No.: 200,323

[22] Filed: Oct. 24, 1980

Related U.S. Application Data

[63] Continuation-in-part of Ser. No. 101,196, Dec. 7, 1979, abandoned.

[51] Int. Cl.[3] ..... G03C 1/52

[52] U.S. Cl. ..... 430/178; 430/177; 430/171; 430/340; 430/341; 430/339; 430/179

[58] Field of Search ..... 430/177, 340, 341, 339, 430/178, 171, 179

[56] References Cited

U.S. PATENT DOCUMENTS

| | | | |
|---|---|---|---|
| 1,916,350 | 7/1933 | Wendt et al. | 430/339 |
| 2,324,060 | 7/1943 | Boughton | 430/338 |
| 2,756,144 | 7/1956 | Ravich | 430/339 |
| 2,772,284 | 11/1958 | Barnhart et al. . | |
| 2,880,153 | 3/1959 | Hiltz et al. | 204/158 |
| 2,884,326 | 4/1959 | Zemp et al. . | |
| 3,390,997 | 7/1968 | Read . | |
| 3,460,964 | 8/1969 | Dunham . | |
| 3,502,476 | 3/1970 | Itano et al. | 430/344 |
| 3,595,655 | 7/1971 | Robinson et al. | 430/339 |
| 3,595,657 | 7/1971 | Robinson et al. | 430/339 |
| 3,615,563 | 10/1971 | Chalkley | 430/341 |
| 3,801,319 | 4/1974 | Saeva . | |
| 3,920,457 | 11/1975 | Cunningham et al. | 430/338 |
| 4,017,313 | 4/1977 | Hartzler . | |
| 4,045,221 | 8/1977 | Dominh | 430/341 |

FOREIGN PATENT DOCUMENTS

| | | |
|---|---|---|
| 51-941 | 1/1976 | Japan . |
| 51-27544 | 8/1976 | Japan . |
| 51-43786 | 11/1976 | Japan . |
| 52-23806 | 6/1977 | Japan . |
| 52-25330 | 7/1977 | Japan . |
| 53-102038 | 9/1978 | Japan . |

OTHER PUBLICATIONS

Kosar, J., "Light-Sensitive Systems," John Wiley & Sons, Inc., New York, 1965, pp. 187 and 193.

Chemical Abstracts, 1979, vol. 90: 95427q.

Hartzler, H. D., "Aromatic Aldehyde-Leuco Dye Photoxidation," Pure and Applied Chemistry, vol. 49, pp. 353-356, Pergamon Press, G. B. 1977.

Kosar, J., "Light-Sensitive Systems," John Wiley & Sons, Inc., N.Y., N.Y., pp. 380 and 398.

*Primary Examiner*—Won H. Louie, Jr.

*Attorney, Agent, or Firm*—Cruzan Alexander; Donald M. Sell; Mark A. Litman

[57] ABSTRACT

An imageable layer comprising a polymeric binder, a bleachable dye or a leuco dye, a nitrate salt, and a photosensitive diazonium salt, the nitrate salt in the imageable layer being capable of liberating $HNO_3$, NO, $NO_2$ or $N_2O_4$ in oxidizing amounts when the layer is heated to no more than 200° C. for 60 seconds.

18 Claims, No Drawings

LIGHT SENSITIVE, THERMALLY DEVELOPABLE IMAGING SYSTEM

This application is a continuation-in-part of U.S. patent application Ser. No. 101,196, filed Dec. 7, 1979, abandoned.

FIELD OF THE INVENTION

The present invention relates to light sensitive imaging systems. More particularly the invention relates to light sensitive, thermally developable diazonium salt imaging systems.

SUMMARY OF THE INVENTION

The present invention relates to an imaging system comprising (1) a polymeric binder resin, (2) any bleachable dye or a leuco dye, (3) a nitrate salt, and (4) a light sensitive diazonium salt. In addition to these active ingredients, a material which supplies hydrogen ion, such as an acidic material, and in particular an acid, is a desirable ingredient. Both positive and negative acting systems may be produced. After exposing the system to light, the application of heat will develop the image by bleaching the dye or oxidizing the leuco dye more rapidly in either the exposed or unexposed region. The presence of the acidic material accelerates the decolorization or colorizing phenomenon.

When the leuco dye is used in place of a dye, the leuco dye is oxidized to form a colored dye upon the application of heat. A positive acting system or negative acting system will result because of the differential rate of oxidation occuring in exposed and unexposed regions.

DETAILED DESCRIPTION OF THE INVENTION

There are a minimum of four components to the imageable systems of the present invention, and five components to the preferred constructions. The four required ingredients are (1) a bleachabale dye or a leuco dye, (2) a nitrate salt, (3) a light sensitive diazonium salt, and (4) a polymeric resin. An acidic material constitutes the preferred fifth ingredient.

THE BINDER

Any natural or synthetic polymeric binder may be used in the practice of the present invention. The pH of the resin has been found to affect only the speed of the decolorizing or colorizing effect. If the speed is not important, any resin may be used. Organic polymeric resins, preferably thermoplastic resins (although thermoset resins may be used), are generally preferred. Where speed is more important, either the more acidic resins should be used or an acid should be added to the system to reduce the pH and increase the rate of decolorizing or colorizing (i.e., leuco dye oxidizing). Such resins as polyvinyl acetals, polyesters, polyvinyl resins, polyvinylpyrolidone, polyesters, polycarbonates, polyamides, polyvinyl butyral, polyacrylates, cellulose esters, copolymers and blends of these classes of resins, and others have been used with particular success. Natural polymeric materials such as gelatin and gum arabic may also be used. Where the proportions and activities of dyes and nitrate salt require a particular developing time and temperature, the resin should be able to withstand those conditions. Generally it is preferred that the polymer not decompose or lose its structural integrity at 200° F. (93° C.) for 30 seconds and most preferred that it not decompose or lose its structural integrity at 260° F. (127° C.) for 30 seconds.

Beyond these minimal requirements, there is no criticality in the selection of a binder. In fact, even transparency and translucency are not required, although they are desirable. Where, for example, the polymer is itself an opaque white, the light struck and thermally treated area in decolorizable systems will become white and the non-treated areas will remain the color of the dye.

The binder serves a number of additionally important purposes in the constructions of the present invention. The imageable materials are protected from ambient conditions such as moisture. The consistency of the coating and its image quality are improved. The durability of the final image is also significantly improved. The binder should be present as at least 25% by weight of ingredients in the layer, more preferably as 50% by weight and most preferably as at least 70% by weight of dry ingredients (i.e., excluding solvents in the layer).

THE NITRATE SALT

Nitrate salts are themselves well known. It may be supplied as various compound forms, but are preferably provided as a metal salt, and most preferably provided as a hydrated metal salt. Other ions which are ordinarily good oxidizing ions such as nitrite, chlorate, iodate, perchlorate, periodate, and persulfate do not provide comparable results. Extremely active oxidizing agents, such as iodate, even used in relatively smaller proportions to prevent complete and immediate oxidation or decolorization of dyes, do not perform nearly as well as nitrate ion compositions. The performance of nitrate is so far superior to any other ion that it is apparently unique in the practice of the present invention. While some of the better oxidizing ions other than nitrate can produce a maximum density ($D_{max}$) in the image of about 0.90 and a minimum density ($D_{min}$) of 0.25 in their best construction, the better constructions with nitrate ions can have a $D_{max}$ in excess of 1.0 and a $D_{min}$ below 0.20 or even 0.10.

Most means of supplying the nitrate ion into the composition is satisfactory. Metal salts, acids, acid salts and other means of supplying the ion are useful. For example, nitrates of zinc, cadmium, potassium, calcium, zirconyl, nickel, aluminum, chromium, iron, copper, tin, magnesium, lead, silver and cobalt, ammonium nitrate, and ceric ammonium nitrate have been used.

The nitrate salt component of the present invention must be present in a form within the imaging layer so that oxidizing quantities of $HNO_3$, NO, $NO_2$, or $N_2O_4$ will be provided within the layer when it is heated to a temperature no greater than 200° C. for 60 seconds and preferably no greater than 160° C. for 60 or most preferably 30 seconds. This may be accomplished with many different types of salts, both organic and inorganic, and in variously different types of constructions.

The most convenient way of providing such thermal oxidant providing nitrate salts is to provide a hydrated nitrate salt such as aluminum nitrate nonahydrate ($Al(NO_3)_2.9H_2O$). This salt, when heated in a binder, will generate $HNO_3$, NO, $NO_2$ and/or $N_2O_4$ in various amounts. The binder should not be at such a high pH that the liberated nitric acid would be immediately neutralized as this would adversely affect the oxidizing capability of the system. It is not essential that a completely acidic or neutral pH environment be provided, but pH levels above 8.5 may in many cases completely prevent oxidation. It is therefore desired that the nitrate salt containing layer have a pH less than 7.5, preferably equal to or less than 7.0, and more preferably equal to or less than 6.5.

In addition to hydrated nitrate salts, non-hydrated salts in layers having a pH less than 7.5, and preferably in an acidic environment are also capable of providing $HNO_3$, NO, $NO_2$ and/or $N_2O_4$ in sufficient quantities to provide the oxidizing capability necessary for practice of the present invention. Ammonium nitrate, for example, does not enable good oxidation in the present invention in a layer having a pH of 8.0 or higher, but when a moderate strength organic acid such as phthalic acid is added to lower the pH to below 7.0, a quite acceptable imaging system is provided.

Beside the inorganic types of salts generally desribed above, organic salts in non-alkaline environments are also quite useful in the practice of the present invention. In particular, nitrated quaternary ammonium salts such as guanadinium nitrate work quite well in acid environments, but will not provide any useful image at alkaline pH levels of 8.0 or higher.

It is believed that the alkaline environment causes any oxidizing agent (e.g., $HNO_3$, NO, $NO_2$ and/or $N_2O_4$) which is liberated from the nitrate salt to be preferentially reacted with hydroxy ions or other neutralizing moieties so as to prevent oxidation of the dyes. For this reason it is preferred to have the environment of the nitrate salt at a pH no greater than 7.0 and more preferably less than 6.5.

One other consideration should be given in the selection of the nitrate salt and that is the choice of a salt in which the cation is non-reactive with the dye. Non-reactive salts are defined in the practice of the present invention as those salts the cations of which do not spontaneously oxidize the dyes that they are associated with at room temperature. This may be readily determined in a number of fashions. For example, the dye and a non-nitrate (preferably halide) salt of the cation may be codissolved in a solution. If the salt oxidizes the dye spontaneously (within two minutes) at room temperature, it is a reactive salt. Such salts as silver nitrate, in which the cation is itself a strong oxidizing agent, is a reactive salt. Ceric nitrate is also reactive, while hydrated cerous nitrate is not.

Preferred salts are the hydrated metal salts such as nickel nitrate hexahydrate, magnesium nitrate hexahydrate, aluminum nitrate nonahydrate, ferric nitrate nonahydrate, cupric nitrate trihydrate, zinc nitrate hexahydrate, cadmium nitrate tetrahydrate, bismuth nitrate pentahydrate, thorium nitrate tetrahydrate, cobalt nitrate hexahydrate, gadolinium or lanthanum nitrate nonahydrate, mixtures of these hydrated nitrates and the like. Non-hydrated or organic nitrates may be admixed therewith.

Organic nitrates are also quite useful in the practice of the present invention. These nitrates are usually in the form of quaternary nitrogen containing compounds such as guanadinium nitrate, pyridinium nitrate, and the like. Nitrated dyes will also be useful, but again, they must be used in an environment which will not neutralize any liberated $HNO_3$, NO, $NO_2$, and/or $N_2O_4$.

It is perferred to have at least 0.10 moles of nitrate ion per mole of dye. It is more preferred to have at least 0.30 or 0.50 moles of ion per mole of dye. Even amounts of form 1.0 to 100 moles of nitrate ion per mole of dye have been found useful. With dyes having relatively higher oxidation potentials, more nitrate is desirable.

DYES

The dyes which are useful in the decolorizable systems of the present invention are any bleachable dye. In some constructions it may be preferable to use those which have an oxidation potential of less than or equal to +1.0. These dyes may be selected from any class of dyes. These classes include but are not limited to methines, indamines, anthraquinones, triarylemethanes, benzylidenes, monoazos, oxazines, azines, thiazines, xanthenes, indigoids, oxonols, cyanines, merocyanines, phenols, naphthols, pyrazolones, and others, of which most are classified by the Colour Index System.

The measurement of oxidation potentials is well known to the ordinarily skilled artisan. The measurements in the present invention are taken by measuring the voltage and current transferred between a carbon and a platinum electrode through the appropriate solution. 0.1 M lithium chloride in anhydrous methanol with 1 to 10 millimoles/liter of the appropriate dye was the standard solution used in the measurements given herein with a saturated calomel electrode.

It is preferred to have sufficient decolorizable dye in the binder prior to imaging so that at least 15% of incident radiation (including ultraviolet and infrared) in a 50 nm range would be absorbed through a 0.5 mm layer of binder and dye. Preferably at least 50 or 75% of the incident radiation in a 20 nm range would be absorbed. These ranges must of course be chosen within the spectral absorption region of the particular dye, but such absorption in any portion of the spectra is useful. In terms of weight percentages, it would be preferred to have at least 0.30% by weight of either colorizable (i.e., lecuo dye) or decolorizable dye as compared to the binder. Preferably, at least 0.50% by weight of dye to binder is desired and most preferably there should be at least 1% by weight of dye to binder in the layer up to 10% or more.

Leuco dyes are well known in the art. These are colorless dyes which when subjected to an oxidation reaction form a colored dye. These leuco dyes are well known in the art (e.g., *The Theory of the Photographic Process,* 3rd Ed., Mees and James, pp. 283-4, 390-1, Macmillion Co., N.Y.; and *Light-Sensitive Systems,* Kosar, pp. 367, 370–380, 406 (1965) Wiley and Sons, Inc., N.Y.). Amongst the best known leuco dyes are leuco malachite blue, leuco crystal violet, leuco malachite green, and 1(2-(1,3,3-trimethylindolyl))-2-(p-morpholinylphenyl)ethene. Only those leuco dyes which can be converted to colored dyes by oxidation are useful in the practice of the present invention. Acid or base sensitive dyes such as phenolphthalein and other indicator dyes are not useful in the present invention unless they are also oxidizable to a colored state. Indicator dyes would only form transient images or would be too sensitive to changes in the environment.

The dyes which have been specifically shown to work in the decolorizable systems of the present invention include but are not limited to the following:

Methines

-continued
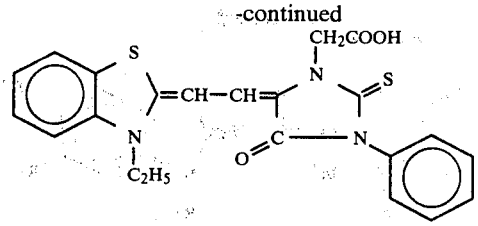
II
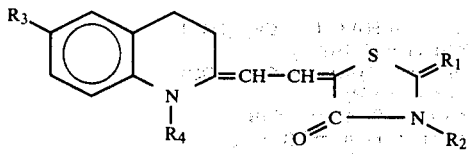
wherein
$R_1 =$ 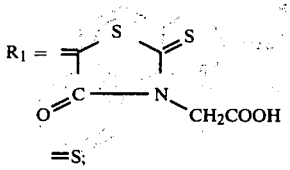
$=S$;
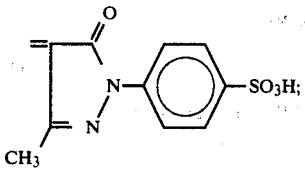
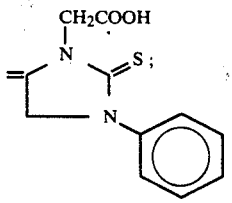
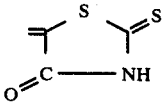
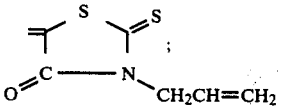
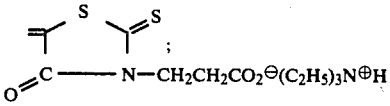
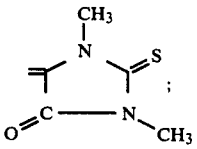
$=CHNO_2$; or 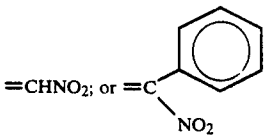
-continued
I
$R_2 = C_2H_5$; $C_7H_{15}$; $(CH_2)_5COOH$; $C_8H_{17}$; $CH_2CH_2\phi$; or $CH_2COOH$
$R_3 = H$; $C_2H_5O$; or Cl
$R_4 = C_2H_5$; or $CH_2CH_2C_6H_5$
III
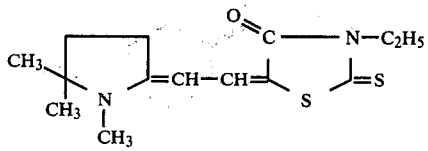
IV
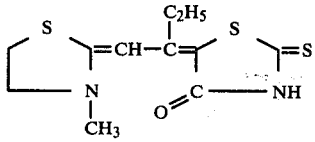
V
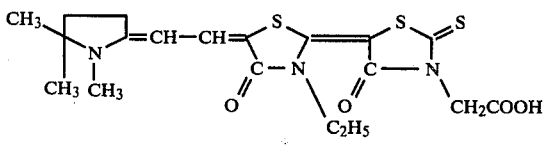
VI
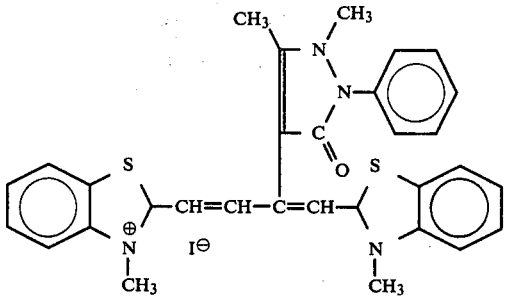
VII
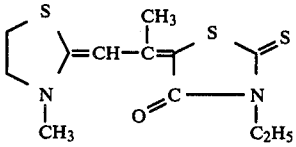
VIII
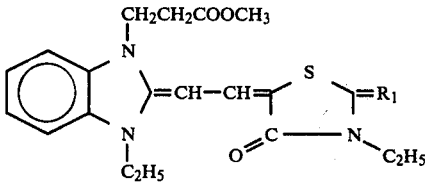
wherein
$R_1 =$ 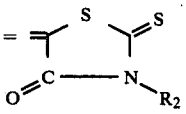
$R_2 = H$; $-CH_2COOH$; or $-CH_2CH{=}CH_2$
IX
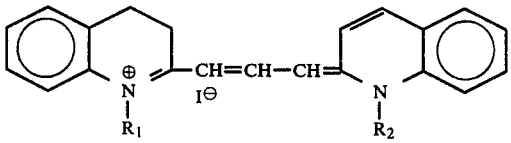
wherein -continued $R_1 = C_2H_5$; n-$C_3H_7 = R_2$

X

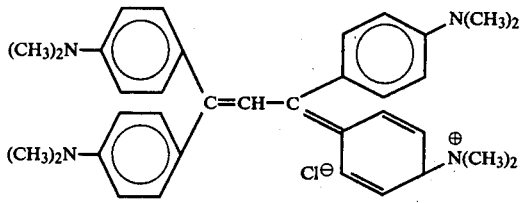

XI

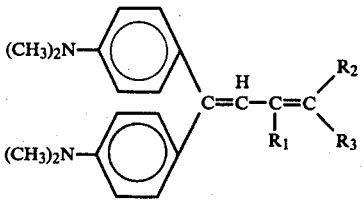

wherein
$R_1$ = H; or —CN
$R_2$ = —CN; or $—SO_2CF_3 = R_3$

XII

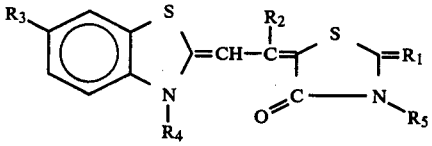

wherein
$R_1$ = =S;

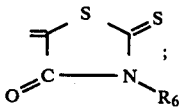

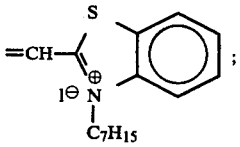

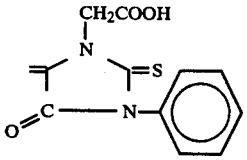

$R_2$ = H; $CH_3 = R_3$
$R_4 = C_2H_5$; $CH_2CH{=}CH_2$; or $CH_2CH_2CO_2C_2H_5$
$R_5$ = $—C_2H_5$; $—CH_2CH—CH_2$; or $—C_7H_{15}$
$R_6$ = $—CH_2COOH$; $—CH_2CH{=}CH_2$; or $—(CH_2)_2SO_3H$

XIII

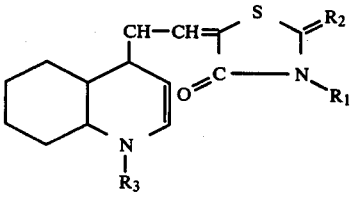

wherein
$R_1$ = $—C_2H_5$; $—C_7H_{15}$; or $—CH_2CH{=}CH_2$
$R_2$ = =S; or $=C(CN)_2$ -continued $R_3$ = $—CH_3$; or $—C_2H_5$

XIV

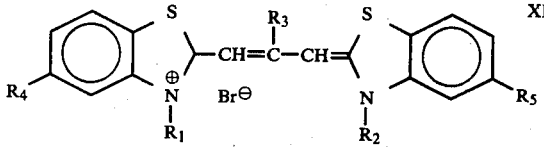

wherein
$R_1$ = $—C_2H_5$; $—(CH_2)_2OH$; $—(CH_2)_2COOH$; $—CH_2COOH$; or $—(CH_2)_3SO_3—$
$R_2$ = $—C_2H_5$; $—(CH_2)_2OH$; $—(CH_2)_2COOH$; $—CH_2COOH$; or $—CH_3$
$R_3$ = H; $—CH_3$; $—SCH_3$; or $—C_2H_5$
$R_4$ = H; $—CH_3$; —Br; or $—N(C_2H_5)_2$
$R_5$ = H; $—CH_3$; or —Br

XV

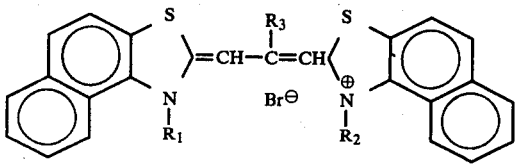

wherein
$R_1$ = $—CH_3$; $—C_2H_5 = R_2 = R_3$

XVI

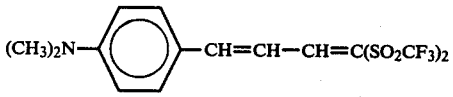

XVII

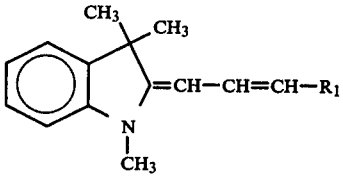

wherein

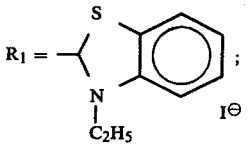

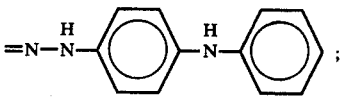

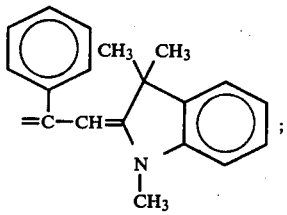

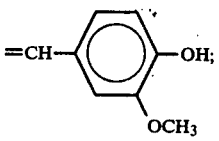

-continued
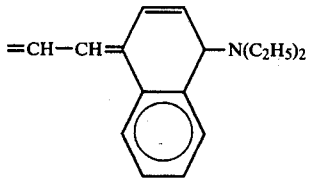
$R_3$ = H; Br
XXI
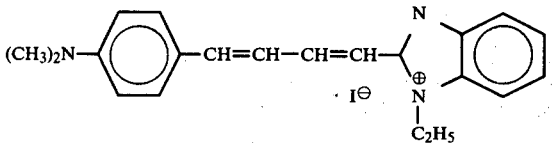
XXII
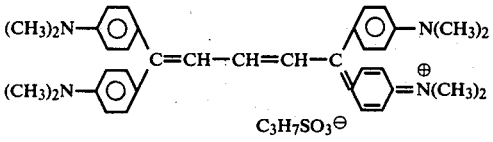
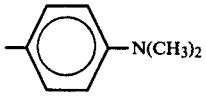
XVIII
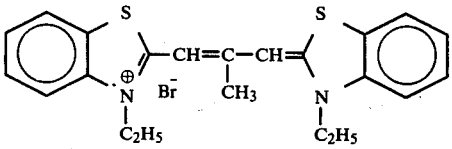
XIX
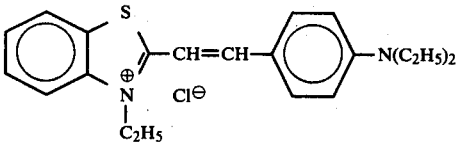
XX
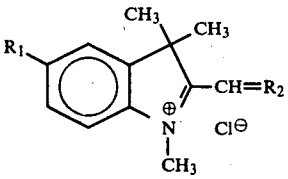
wherein
$R_1$ = H; Cl
$R_2$ = 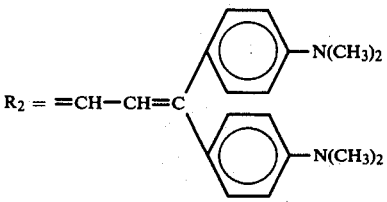 ;
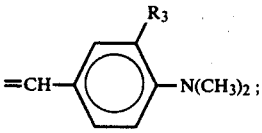
-continued
XXIII
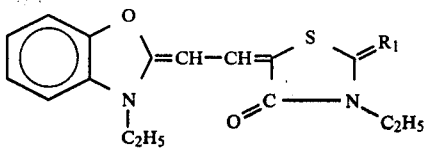
wherein
$R_1$ = S;
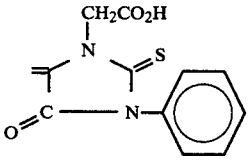
XXIV
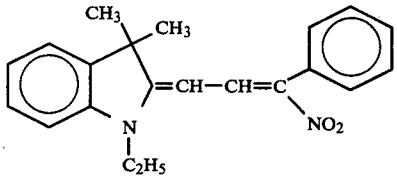
XXV
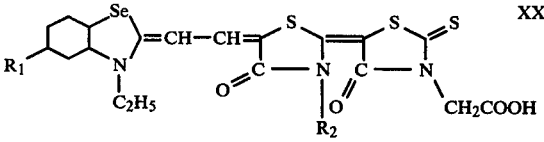
wherein
$R_1$ = $-CH_3$; or $CH_3O-$
$R_2$ = $-C_2H_5$; or $-C_7H_{15}$
XXVI
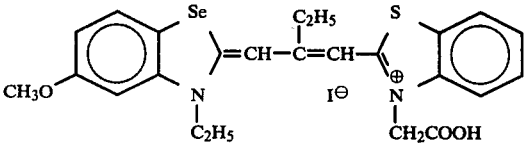
XXVII
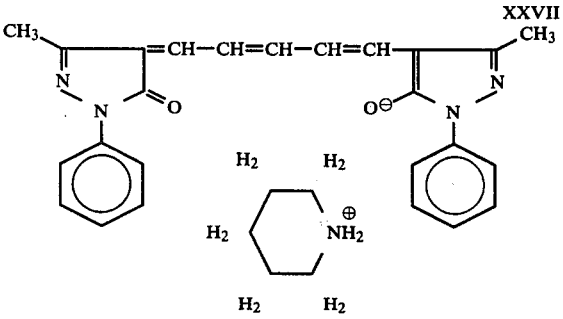
XXVIII
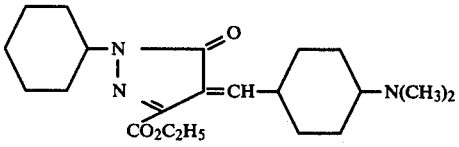

-continued
XXIX
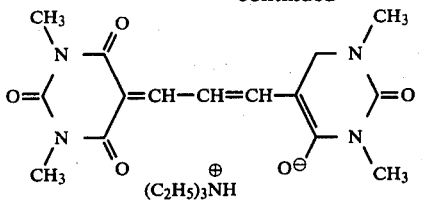
XXX
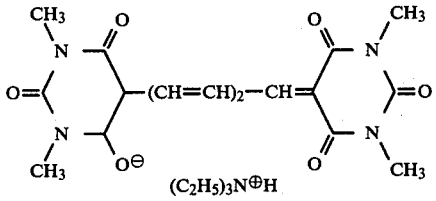
XXXI
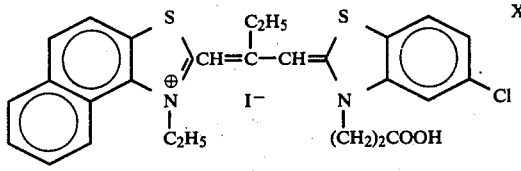
XXXII
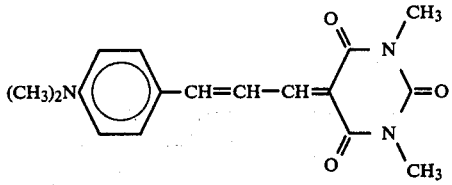
Anthraquinones
XXXIII
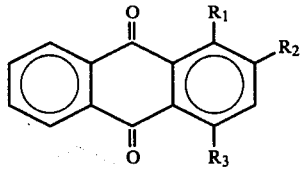
wherein
$R_1$ = —OH; —$NH_2$; —$NHC_2H_5$
$R_2$ = H; —OH; —$OCH_3$
$R_3$ = H; —OH; or —$NHC_2H_5$
Indigoids
XXXIV
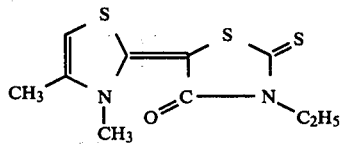
XXXV
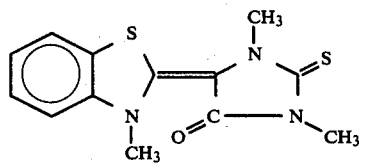
XXXVI
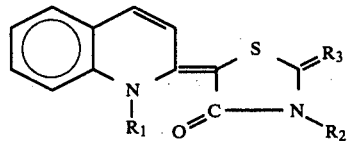
-continued
wherein
$R_1$ = H; —$CH_3$; or —$C_2H_5$
$R_2$ = H; —$C_2H_5$; or —$CH_2COOH$
$R_3$ = =S; or =$CHNO_2$
XXXVII
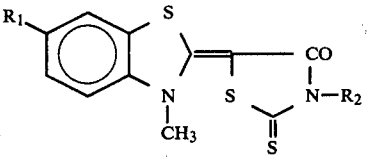
wherein
$R_1$ = H; or $CH_3O$—
$R_2$ = —$C_2H_5$; —$CH_2CO_2^-(C_2H_5)_3N^+H$
Xanthenes
XXXVIII
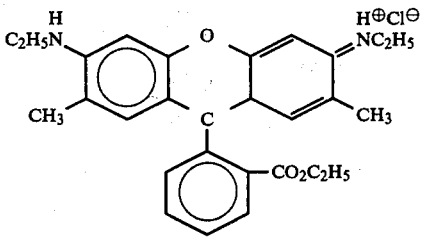
Azines
XXXIX
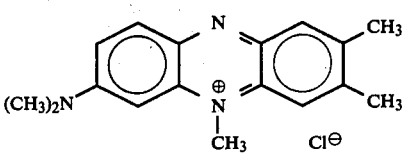
Oxazines
XL
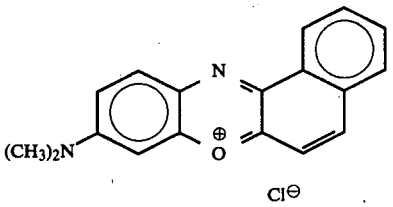
XLI
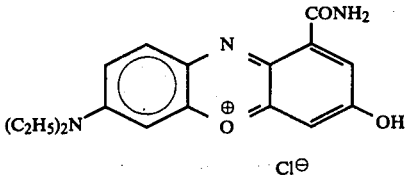
XLII
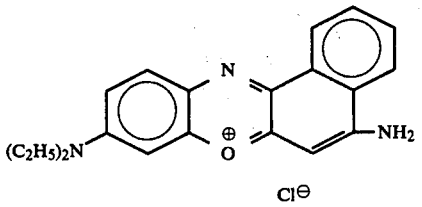
Thiazines -continued

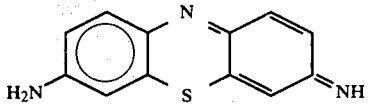

Azos

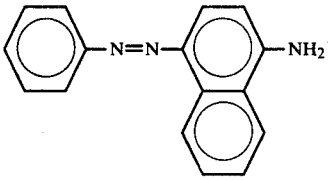

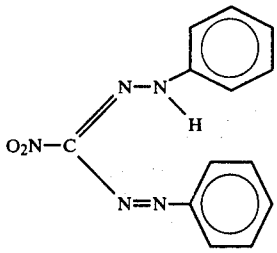

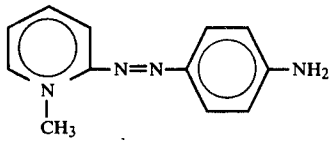

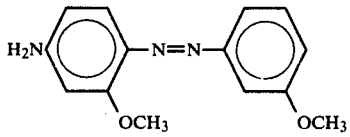

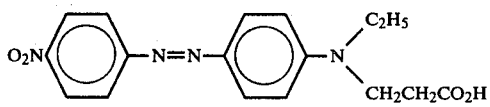

Diazos

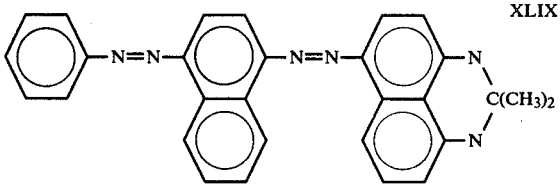

Triarylmethanes

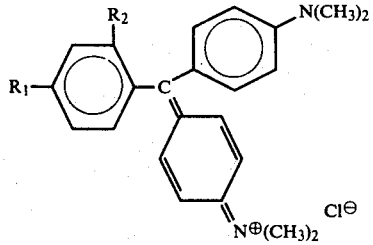

wherein

-continued

XLIII $R_1$ = H; $-N(CH_3)_2$
$R_2$ = H; $-Cl$

XLIV

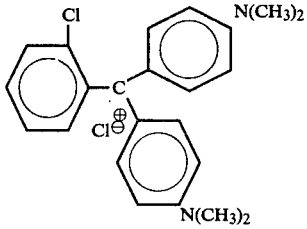

LI

Indamines

XLV

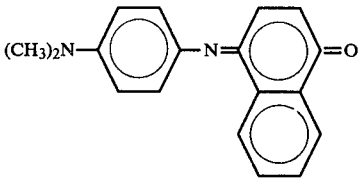

LII

The following two dyes cannot be conveniently classed by the Colour Index System:

XLVI

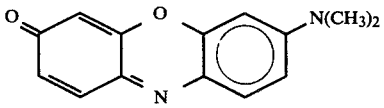

LIII

XLVII

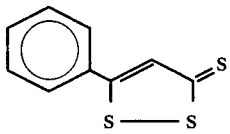

LIV

XLVIII

XLIX

L

These examples are not intended to represent the limits of the present invention. Any dye having an oxidation potential of +1.0 or less may work in the present invention. The substituent groups and dye structure are unimportant.

The decolorizable dyes of the present invention are preferably colored, that is, having absorbance in the visible portion of the electromagnetic spectrum (approximately 400 to 700 nm), but may also be colorless, having absorbance only or predominately in the infrared (700 to 1100 nm) or ultraviolet (310 to 400 nm) portions of the electromagnetic spectrum. The images where colorless dyes are used must then be viewed through a filter, by an ultraviolet or infrared sensitive apparatus, or by some enhancement technique.

It can also be stated that there should be sufficient decolorizable dye present in the layers of this invention so that an optical density of at least 0.1 in the visible portions of the spectrum is present or at least 15% of incident colorless light (including ultraviolet or infrared) is absorbed. It is preferred that an optical density of at least 0.5 or 0.8 be obtained and most preferably that there be sufficient dye so that an optical density of at least 1.0 be obtained in the layer. With colorless dyes (e.g., ultraviolet and infrared absorbing dyes), it is preferred that at least 20% or 40% of incident radiation be absorbed and most preferably that at least 60% or 90% of the incident colorless light within a 20 nm range be absorbed. The leuco dye should be present as at least about 0.3% by weight of the total weight of the light sensitive binder layer, preferably at least 1% by weight, and most preferably at least 2% to 10% or more (e.g., 15%) by weight of the dry weight of the imageable layer. This weight percent is also useful estimating the minimum amount for the decolorizable dyes.

The proportions of nitrate ion and decolorizable dye should be such that on heating the layer at 260° F. (127° C.) for 30 seconds there is at least a 20% reduction in optical density in exposed areas of positive acting systems or unexposed areas in negative acting systems. With a mechanical viewing of the image, a lower reduction in optical density is useful. Depending upon the relative ease of decolorizing the particular dye selected, the relative proportion of nitrate ion to dye may vary. As a general rule, at least 0.1 moles of nitrate ion per mole of dye (whether colorizable (i.e., leuco dye) or decolorizable) is desirable in the practice of the present invention. At least 0.3 or 0.5 moles of nitrate per mole of dye is more preferred, and at least 0.7 or 0.9 moles of nitrate per mole of dye is most preferred. It is usually desired that the decolorizable layers of the present invention provide more than a 20% reduction in optical density upon exposure and development. At least 50% or 60% is preferred and at least 90% or 95% reduction in optical density is most preferred. These reductions can be measured at the development temperatures for the imaging materials, e.g., 130° C. for 60 seconds or 155° C. for 45 seconds.

The acids optionally useful in the present invention are acids as generally known to the skilled chemist. Organic acids are preferred, but inorganic acids (generally in relatively smaller concentrations) are also useful. Organic acids having carboxylic groups are more preferred. The acid may be present in a ratio of from 0 to 10 times the amount of the nitrate ion. More preferably it is present in amounts from 0.2 to 2.0 times the amount of nitrate ion.

In forming or coating imageable layers onto a substrate, temperatures should, of course, not be used during manufacture which would completely colorize or decolorize the layer or decompose the diazonium salts. Some colorization or decolorization is tolerable, with the initial dye or leuco dye concentrations chosen so as to allow for anticipated changes. It is preferred, however, that little or no leuco dye or dye be oxidized during forming or coating so that more standardized layers can be formed. Depending on the anticipated development temperature, the coating or forming temperature can be varied. Therefore, if the anticipated development temperature were, for example, 350° F. (167° C.), the drying temperature could be 280° F. (138° C.). It would therefore not be likely for the layer to gain or lose too much of its optical density at the drying temperature in less than 4–5 minutes. Such a change might be tolerable by correspondingly increasing the amount of leuco dye or dye. A reasonable development temperature range is between 180° F. (82° C.) and 380° F. (193° C.) and a reasonable dwell time is between 5 seconds and 5 minutes, preferably at between 220° F. (105° C.) and 350° F. (167° C.) and for 10 to 180 seconds, with the longer times most likely associated with the lower development temperatures. Therefore, the absorbance characteristics should be considered in relationship to the generally useful development range of 82° C. to 193° C.

Light sensitive diazonium salts are well known in the art. These salts comprise a light sensitive aromatic nucleus with an external diazonium group and an anion associated therewith (e.g., *Light-Sensitive System*, Kosar, pp. 202–214, John Wiley and Sons, Inc. 1965, N.Y.; and *Photographic Chemistry*, Vol. II, P. Glafkides, pp. 709–725, Fountain Press, London). They may be generally represented by the formula:

$$ArN^+NX^-$$

wherein

Ar is an aromatic nucleus, and $X^-$ is an anion.

Any anion may be used on the diazonium salt. Anions as diverse as zinc chloride, tri-isopropyl naphthalene sulfonate, fluoroborate (i.e., $BF_4^-$), and bis(perfluoroalkylsulfonyl)methides may be used. The change in anions may affect the speed of the imaging layer, but not its function. Any light sensitive aromatic diazonium nucleus, as known in the art, may also be used in the practice of the present invention. These nuclei are well known in the art and include, for example P-anilinobenzene; N-(4-diazo-2,4-dimethoxy phenyl)pyrollidine; 1-diazo-2,4-diethoxy-4- morpholino benzene; 1-diazo-4-benzoyl amino-2, 5-diethoxy benzene; 4-diazo--2,5-dibutoxy phenyl morpholino; 4-diazo-1-dimethyl aniline; 1-diazo-N,N-dimethyl aniline; 3-methyl- 4-pyrollidone benzene; 1-diazo-4-N-methyl-N-hydroxyethyl aniline; etc. Light sensitive oligomeric diazonium resins as known in the art (e.g., U.S. Pat. No. 2,714,066) are useful and are specifically included within the definition of diazonium salts as they are merely condensation products of the salts (with aldehydes such as formaldehyde) and retain their light sensitive and active properties. These salts should be present as at least about 0.1% by weight of the dried imaging layer up to 15% or more. Preferably they are present as from 0.3–10% by weight of the layer and most preferably as 0.5–5% by weight of the layer and in at least equal molar proportions to the dye or leuco dye.

Additional ingredients such as surfactants, antistatic agents, flow control aids, antioxidants (e.g., hindered phenols, phenidone, and ascorbic acid), and other general aids may be present in the imaging layer.

All of this will be more thoroughly understood by consideration of the following examples:

EXAMPLES 1–18

A reference coating solution was prepared by mixing 66.67 g of a 15% solution of cellulose acetate butyrate (in a solvent solution comprising 10 parts methylisobutylketone, 20 parts methanol, and 55 parts acetone) with 0.05 g phenidone A, 0.15 g phthalic acid, 0.49 g benzotriazole, 0.38 g of 1-diazo-2,5-dimethoxy-4-morpholinobenzene zinc chloride, 0.335 g leuco crystal violet, 4.43 g methanol, 12.50 g acetone, and 5.00 g tetrahydrofuran. The indicated weight of each nitrate shown in the table below was dissolved in methanol to a total weight of 1 g, and this was added to 9 g of the reference coating solution. Each final solution was coated at 4 mils wet thickness onto polyethylene terephthalate film and dried for four minutes at 71° C. Each coated film was imagewise exposed to ultraviolet light until the diazonium salt in the light struck areas was decomposed. One portion of each film was developed at 99° C. and another sample was developed at 139° C. for various times, visually determining when optimum development occurred. The optical density in the light struck (LS) areas and the non-light struck (NLS) areas was recorded. The results appear below, with all developing times (Dev. Time) reported in seconds.

| Example | Salt | Weight (g) | Optical Densities (LS/NLS) 99° C. | (Dev. Time) | 139° C. | (Dev. Time) |
|---|---|---|---|---|---|---|
| 1 | $Ni(NO_3)_2.6H_2O$ | 0.026 | 0.11/0.08 | 25 | 0.22/1.48 | 25 |
| 2 | $Mg(NO_3)_2.6H_2O$ | 0.023 | 0.80/0.09 | 20 | 1.32/1.47 | 10 |
| 3 | $Cu(NO_3)_2.3H_2O$ | 0.022 | 0.20/0.15 | 20 | 0.50/1.46 | 20 |
| 4 | *$Zn(NO_3)_2.6H_2O$ | 0.027 | 0.30/.14 | 40 | 0.24/1.56 | 30 |
| 5 | $Cd(NO_3)_2.4H_2O$ | 0.028 | 0.15/0.10 | 40 | 0.28/1.54 | 40 |
| 6 | $Co(NO_3)_2.6H_2O$ | 0.026 | 0.15/0.10 | 20 | 0.28/1.50 | 25 |
| 7 | $^{+}Ba(NO_3)_2$ | 0.024 | — | — | 0.15/0.29 | 40 |
| 8 | $Al(NO_3)_3.9H_2O$ | 0.023 | 0.12/0.09 | 25 | 0.20/1.52 | 20 |
| 9 | $^{x}Bi(NO_3)_3.5H_2O$ | 0.029 | 0.13/0.11 | 20 | 0.20/1.40 | 20 |
| 10 | $Fe(NO_3)_3.9H_2O$ | 0.024 | 0.84/0.30 | 10 | 1.30/1.42 | 10 |
| 11 | $Cr(NO_3)_3.9H_2O$ | 0.024 | 0.63/0.27 | 10 | 1.27/1.41 | 10 |
| 12 | $(NH_4)_2Ce(NO_3)_6$ | 0.016 | 0.13/0.13 | 30 | 0.30/1.65 | 45 |
| 13 | $Ga(NO_3)_3.9H_2O$ | 0.025 | 0.13/0.11 | 25 | 0.18/1.52 | 30 |
| 14 | $Th(NO_3)_4.4H_2O$ | 0.25 | 0.13/0.11 | 20 | 0.20/1.56 | 30 |
| 15 | $ZrO_2(NO_3)_2.H_2O$ | 0.022 | 0.12/0.12 | 15 | 0.19/1.56 | 30 |
| 16 | $AgNO_3$ | 0.031 | 0.20/0.12 | 25 | 0.29/1.57 | 60 |
| 17 | $NaNO_3$ | 0.015 | — | — | 0.18/0.43 | 60 |
| 18 | $^{o}KNO_3$ | 0.18 | — | — | 0.13/0.17 | 60 |

*ethanol replaced methanol as solvent
+acetic acid substituted for methanol
xacetone substituted for methanol
o+0.5 g glycerol In addition to the showing of general utility for all the various forms of nitrate ion, certain unusual characteristics can be seen. Most examples showed only modest or negligible negative image formation upon heating to 99° C. Most examples showed positive image formation upon heating to 139° C. Thus either positive and negative images may be produced from most of the imaging systems of the present invention depending upon development temperatures.

EXAMPLES 19–45

Two separate solutions were prepared. One comprised 0.23 g $Al(NO_3)_3.9H_2O$ in 19.77 g methanol. The other was identical to the reference solution of examples 1–18 except that no diazonium salt was present and only 3.81 g of methanol was added (excluding that already with the resin). Various diazonium salts, in equimolar proportions with the dye, were added to the nitrate solution and dissolved. Two grams of this was then combined with 8 grams of the dye containing solution and coated and dried as in the previous examples. The same exposure, developments, and recordings were made as in the previous examples, and the results are shown below.

| Example | Diazonium Salt | Weight (g) | Optical Density (LS/NLS) 99° C. | (Dev. Time) | 139° C. | (Dev. Time) |
|---|---|---|---|---|---|---|
| 19 | N—(4-diazo-2,5-dimethoxy phenyl)pyrrolidine borofluoride | 0.29 | 0.07/0.06 | 25 | 0.09/0.17 | 60 |
| 20 | N—(4-diazo-2,5-diethoxy phenyl)pyrrolidine borofluoride | 0.031 | 0.07/0.06 | 30 | 0.09/0.15 | 60 |
| 21 | 1-diazo-2,5-diethoxy-4-morpholino benzene borofluoride | 0.033 | 0.09/0.06 | 20 | 0.18/1.53 | 55 |
| 22 | Condensation product, diphenyl amine-4-diazonium chloride ½ $ZnCl_2$ + formaldehyde | 0.027 | 1.00/0.14 | 15 | 1.37/1.45 | 15 |
| 23 | 1-diazo-4-N,N—dimethyl aniline borofluoride | 0.021 | 0.20/0.13 | 30 | 0.40/1.60 | 90 |
| 24 | 1-diazo-3-methyl-4-pyrrolidino benzene zinc chloride | 0.032 | 0.30/0.07 | 40 | 0.50/1.30 | 40 |
| 25 | 3-methyl-4-pyrrolidino-benzene-diazonium fluoroborate | 0.025 | 0.13/0.08 | 30 | 0.18/1.48 | 40 |
| 26 | 2,5-Di-n-butoxy-4-morpholino-benzene diazonium chloride, ½ zinc chloride | 0.037 | 0.11/0.05 | 40 | 0.25/1.52 | 40 |
| 27 | 2,5-Diethoxy-4-(p-tolylthio)-benzene diazonium chloride, ½ zinc chloride | 0.036 | 0.65/0.55 | 10 | 1.09/1.19 | 15 |
| 28 | $BF_4$ Diphenylamine-4-diazonium fluoroborate | 0.025 | 0.20/0.16 | 40 | 0.70/1.55 | 35 |
| 29 | para-nitrobenzene-diazonium fluoroborate | 0.21 | — | — | 1.13/1.13 | 60 |
| 30 | 1-diazo-4-benzoyl amino-2,5-diethoxy benzene, ½ zinc chloride | 0.037 | 0.50/0.09 | 15 | 1.32/1.42 | 20 |
| 31 | 1-diazo-2,5-diethoxy-4-morpholino benzene, ½ zinc | 0.034 | 0.28/0.15 | 30 | 0.40/0.35 | 90 |

-continued

| Example | Diazonium Salt | Weight (g) | Optical Density (LS/NLS) 99° C. | (Dev. Time) | 139° C. | (Dev. Time) |
|---|---|---|---|---|---|---|
| | chloride | | | | | |
| 32 | 1-diazo-3-methyl-4-pyrrolidino benzene chloride zinc chloride | 0.032 | 0.11/0.05 | 30 | 0.20/1.10 | 60 |
| 33 | 1-diazo-2,5,dimethoxy-4-morpholino benzene zinc chloride | 0.038 | 0.11/0.06 | 25 | 0.20/1.42 | 30 |
| 34 | 4-diazo-2,5-dibutoxy-phenyl-morpholino borofluoride | 0.037 | 0.30/0.05 | 40 | 1.30/1.50 | 25 |
| 35 | 4-diazo-1-dimethyl aniline zinc chloride | 0.032 | 0.60/0.09 | 50 | 1.25/1.23 | 60 |
| 36 | 4-diazo-1-diethyl aniline zinc chloride | 0.033 | 1.10/0.10 | 30 | 1.40/1.37 | 50 |
| 37 | 3-Methoxy-4-pyrrolidino-benzene diazonium fluoroborate | 0.026 | 0.07/0.06 | 20 | 0.09/0.35 | 60 |
| 38 | 4-diazo-2,5-dimethoxy-phenyl-morpholino zinc chloride | 0.038 | 1.15/0.08 | 60 | 1.05/1.20 | 50 |
| 39 | 1-diazo-4-N—methyl-N—hydroxy-ethyl aniline ½ zinc chloride | 0.025 | 0.29/0.16 | 20 | 0.49/0.39 | 90 |
| 40 | 1-diazo-4-morpholino-benzene ½ zinc chloride | 0.026 | 0.30/0.17 | 30 | 1.00/1.38 | 30 |
| 41 | 1-diazo-2-ethoxy-4-N,N—diethyl aniline zinc chloride | 0.029 | 0.13/0.13 | 30 | 0.23/0.27 | 90 |
| 42 | 1-diazo-4-N,N—dimethyl analine ½ zinc chloride | 0.023 | 0.23/0.13 | 30 | 0.45/0.48 | 90 |
| 43 | 1-diazo-2,5-dibutoxy-4-morpholino benzene sulfate | 0.048 | 0.76/0.06 | 10 | 1.15/1.26 | 20 |
| 44 | *Condensation product, p-diazo diphenylamine chloride zinc chloride + formaldehyde | 0.030 | 0.70/0.06 | 10 | 1.37/1.47 | 10 |
| 45 | *Condensation product, diphenylamine-4-diazonium tri-isopropyl naphthalene sulfonate + formaldehyde | 0.030 | 0.80/0.08 | 15 | 1.53/1.60 | 10 |

*polymeric salts

Again, the results show general utility for light sensitive diazonium salts. Some are clearly more effective than others, and again both negative and positive imaging can be produced.

EXAMPLES 46–55

A nitrate solution comprising 0.23 g $Al(NO_3)_3.9H_2O$ in 19.77 g methanol was prepared. The selected diazonium salts were added to this solution to form 2 g portions which were then added to 8 g portions of the reference coating solution of Examples 19–45. These were then coated and dried as in the previous examples. Again, the diazonium salts were in approximately equimolar proportions to the dye. The coated film was exposed, developed, and evaluated as in the previous examples.

| Example | Diazonium Salt | Weight (g) | Optical Density (LS/NLS) 99° C. | (Dev. Time) | 139° C. | (Dev. Time) |
|---|---|---|---|---|---|---|
| 46 | 1-diazo-2,5-diethoxy-4-morpholino benzene borofluoride | 0.033 | 0.30/0.07 | 60 | 0.35/1.46 | 40 |
| 47 | 3-Methyl-4-pyrrolidino-benzene-diazonium fluoroborate | 0.025 | 0.23/0.10 | 40 | 0.23/1.45 | 35 |
| 48 | 2,5-Di-n-butoxy-4-morpholino-benzene diazonium chloride, ½ zinc chloride | 0.37 | 1.30/0.08 | 60 | 1.14/1.48 | 25 |
| 49 | 1-diazo-2,5,dimethoxy-4-morpholino benzene zinc chloride | 0.038 | 0.20/0.08 | 40 | 0.23/1.45 | 40 |
| 50 | Diphenylamine-4-diazonium fluoroborate | 0.27 | 0.83/0.78 | 10 | 1.14/1.21 | 15 |
| 51 | 4-diazo-1-diethyl aniline zinc chloride | 0.033 | 0.40/0.16 | 30 | 0.80/1.25 | 60 |
| 52 | 4-diazo-2,5-dimethoxy-phenyl-morpholino zinc chloride | 0.038 | 0.16/0.08 | 40 | 0.15/0.40 | 90 |
| 53 | *Condensation product, diphenylamine-4-diazonium tri-isopropyl naphthalene sulfonate + formaldehyde | 0.027 | 0.55/0.14 | 7 | 1.35/1.37 | 15 |
| 54 | 1-diazo-2,5-dibutoxy-4-mor- | 0.048 | 1.03/0.08 | 10 | 0.31/1.31 | 40 |

-continued

| Example | Diazonium Salt | Weight (g) | Optical Density (LS/NLS) 99° C. | (Dev. Time) | 139° C. | (Dev. Time) |
|---|---|---|---|---|---|---|
| | pholino benzene sulfate | | | | | |

*polymeric salts

EXAMPLE 55

A light sensitive system according to the present invention was constructed in the following manner. A solution was prepared by mixing the following ingredients:

- 0.01 g phenidone A (1-phenyl-3-pyrazolidinone, a reducing agent used as a stabilizer,
- 0.10 g benzotriazole (a stabilizer),
- 0.03 g bis(perfluoromethylsulfonyl)methane $(CF_3SO_2)_2CH_2$
- 0.06 g 1-diazo-2,5-diethoxyphenyl morpholino tetrafluoroborate
- 1.0 g acetone
- 0.70 g of a 4.76% by weight solution of $Ni(NO_3)_2.6H_2O$ in methanol,
- 3.2 g of a 2.15% by weight solution of leuco crystal violet in acetone, and
- 15.0 g of a 15% by weight solids solution of cellulose acetate butyrate in a 10:20:50 solution of methylisobutylketone, methanol and acetone respectively.

This solution was coated on polyester at 3½ mils wet, then dried for four minutes at 71° C. The dried coated film was imagewise exposed to ultraviolet radiation to decompose the diazonium salt in the imaged areas. The exposed film was then developed by heating to 139° C. on a heated roller.

A strong negative image was produced where the color density was greatest where light struck.

EXAMPLE 56

Three solutions were prepared. The first was of 0.10 g Crystal Violet, 5 ml of methanol, and 5 ml of N-methyl-pyrrolidone. The second solution was made from 4 g magnesium nitrate hexahydrate $(Mg(NO_3)_2.(H_2O)$ and 75 ml of methanol. The third solution comprised 20 g cellulose acetate, 10 ml methyl isobutyl ketone, and 70 ml acetone. 3 ml of the first solution was mixed with 3 ml of the second solution an 12.5 g of the third solution. To this was added 0.03 g of 3-methyl-4-pyrrolidino-benzene tetrafluoroborate. This solution was coated onto clear polyethyleneterephthalate film at 4 mils wet thickness and dried for 4 minutes at 70° C.

The dried film was imagewise exposed to ultraviolet light until the diazonium salt had been decomposed in the light struck areas. Upon heating to 130° C. for 40 seconds, a readable image developed. The dye was bleached far more in the light struck areas than in the non- light struck areas, providing a positive image.

EXAMPLE 58

The previous example was duplicated except that an equal weight of Malachite Green was used in place of the Crystal Violet. Substantially similar results were obtained, although a less dense image was produced with the Melachite Green as compared to the Crystal Violet.

EXAMPLE 59

Example 55 was duplicated except that an equal weight of the leuco dye 1(2-(1,3,3-trimethylindolyl))-2-(p-morpholinylphenyl)ethene was used. A substantially similar result was obtained, except that the image was, negative, red and somewhat less dense.

EXAMPLE 60

Example 55 was duplicated except that an equal molar amount of leuco malachite green was used in place of the leuco crystal violet. A green positive image was produced after exposure and development as in Example 59.

EXAMPLE 61

Example 55 was duplicated except an equal molar amount of the leuco dye

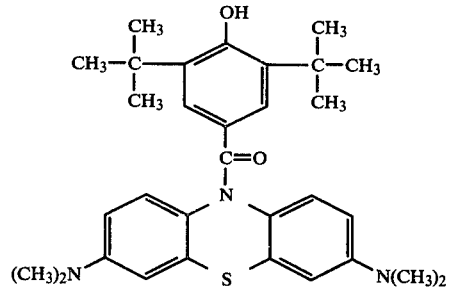

was used in place of leuco crystal. A light blue positive image was produced after exposure and development as in Example 55.

It is important to note that the phenomena by which imaging occurs is not understood. Even the positive or negative nature of the imaging system cannot be predicted. For example, the imaging sheet of Example 61, when left at ambient conditions for three days and then exposed and developed, produced a negative image.

EXAMPLE 62

Example 55 was repeated except that the cellulose acetate butyrate solution was replaced with 15 g of a 30% by weight solution of cellulose acetate propionate in a 10:20:40 solution of the same solvents respectively. When imaged and then developed at 99° C., a strong negative image was produced.

EXAMPLE 63

Example 55 was repeated except that equimolar proportions of the following dyes were used in place of the leuco crystal violet:

63. Dye No. I
64. Dye No. II wherein $R_1$ is

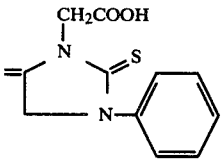

and $R_2$ is $C_2H_5$

65. Dye No. III
66. Dye No. IV
67. Dye No. VI
68. Dye No. VII
69. Dye No. IX
70. Dye No. XI
71. Dye No. XIII wherein $R_1$ is $C_2H_5$, $r_2$ is S and $R_3$ is $CH_3$
72. Dye No. XVI
73. Dye No. XXI
74. Dye No. XXVII
75. Dye No. XXX
76. Dye No. XXXI wherein $R_1$ is $NH_2$, $R_2$ and $R_3$ are H
77. Dye No. XXXIV
78. Dye No. XXXVIII
79. Dye No. XXXIX
80. Dye No. XL
81. Dye No. XLIII
82. Dye No. XLIV
83. Dye No. XLVII
84. Dye No. XLIX
85. Dye No. LII No other light-sensitive agents are necessary in the constructions of the present invention beyond those described in order to provide good quality images. Other components besides those specifically described may of course be added to the system when found useful. The sheets were coated and dried as in Example 55. Each of the coated polyester sheets were initially colored due to the presence of the dye. Exposure and development was the same as in that Example, but the images were now generally positive images, with the color density the lowest where light struck.

The imaging layers of the present invention must allow reactive association amongst the active ingredients in order to enable imaging. That is, the individual ingredients may not be separated by impenetrable barriers within the layer, as in dispersed immiscible phases. Generally, the active ingredients are homogeneously mixed (e.g., a molecular mixture of ingredients) within the layer. They may be individually maintained in heat softenable binders which are dispersed or mixed within the layer and which soften upon heating to allow migration of ingredients, but this would require a longer development time.

The imaging layers of the present invention may contain various materials in combination with the essential ingredients of the present invention. For example, lubricants, coating aids, antioxidants (e.g., ascorbic acid, hindered phenols, phenidone, etc. in amounts that would not prevent oxidation of the dyes when heated), surfactants, antistatic agents, mild oxidizing agents in addition to the nitrate, and brighteners may be used without adversely affecting practice of the invention.

The imaging layers of the present invention must allow reactive association of the active ingredients in order to enable imaging. That is, the individual ingredients may not be separated by impenetrable barriers within the layer, as with dispersed immiscible phases. Generally, the active ingredients are homogeneously mixed (e.g., a molecular mixture of ingredients) within the layer. They may be individually maintained in heat softenable binders which are dispersed or mixed within the layer and which soften upon heating to allow migration of ingredients, but this would require a longer development time.

A reasonable basis for determining the acidity of the coating composition (e.g., whether it is below a pH of 7.0 as described herein) is to evaluate the stability of a specific diazonium salt in the composition. Using the specific salt of Example 19, if more than 25% by weight of the diazonium salt decomposes, the pH is probably too much above 7.0.

One noteworthy property of this system is amplification of the latent image. By amplification in the leuco dye containing construction is meant that more than one molecule of dye is formed for each absorbed photon of radiation. The degree of amplification, that is the ratio of the number of dye molecules formed to photons absorbed, may be as high as $1\times10^3$.

What is claimed is:

1. An imageable layer comprising (a) a polymeric binder, (b) a bleachable dye or a leuco dye, (c) a nitrate salt, and (d) a photosensitive diazonium salt, said nitrate salt in said imageable layer being capable of liberating $HNO_3$, NO, $NO_2$ or $N_2O_4$ in oxidizing amounts when said layer is heated to no more that 200° C. for 60 seconds.

2. The layer of claim 1 wherein a leuco dye is present as at least 0.3% by weight of the layer, the nitrate salt is present in a molar ratio to the leuco dye of at least 0.1 nitrate/1.0 dye, the diazonium salt is present as at least 0.1% by weight of the layer, and the binder comprises at least 25% by weight of the layer.

3. The layer of claim 1 wherein a dye having an oxidation potential of less than +1.0 is present so that there is an optical density of at least 0.1 in the layer from the dye, and the nitrate ion is present in a molar ratio to the dye of at least 0.1 nitrate/1.0 dye.

4. The layer of claims 1, 2, or 3 wherein an acid is also present in said layer.

5. The layer of claim 4 wherein said acid is an organic carboxylic acid.

6. The layer of claims 1, 2, 3 wherein said nitrate ion is present as a metal nitrate salt.

7. The layer of claim 6 wherein said metal nitrate salt is present as a hydrated metal nitrate salt.

8. The layer of claims 1, 2 or 3 wherein said metal nitrate salt is a hydrated metal nitrate salt of at least one of the group consisting of zinc, cadmium, nickel, aluminum, iron, tin, copper, magnesium, chromium, cobalt and calcium.

9. The layer of claim 2 wherein said leuco dye comprises at least 1% by weight of said layer and said nitrate salt provides at least 0.5 moles of nitrate ion per mole of leuco dye.

10. The layer of claim 3 wherein said dye is at least 1% by weight of said layer and said nitrate salt provides at least 0.5 moles of nitrate ion per mole of dye.

11. The layer of claim 9 wherein said binder comprises at least 70% by weight of the imageable layer.

12. The layer of claim 4 wherein said binder comprises at least 70% by weight of the imageable layer.

13. The layer of claim 8 wherein said binder comprises at least 70% by weight of the imageable layer.

14. The layer of claims 1, 2, 3, or 9 wherein an antioxidant is present.

15. The layer of claim 3 wherein said dye is selected from the class consisting of methine, anthraquinone, xanthene, azine, oxazine, thiazine, azo, diazo, triarylmethane, benzylidene, oxonol, merocyanine, phenol, naphthol and pyrazolone dyes.

16. The layer of claim 15 wherein an acid is also present in said layer.

17. The layer of claim 16 wherein said acid is an organic carboxylic acid present as from 0.2 to 2.0 times the weight of nitrate ion.

18. The layer of claim 4, wherein an antioxidant is present.

* * * * *